United States Patent [19]

Steck

[11] Patent Number: 4,538,796

[45] Date of Patent: Sep. 3, 1985

[54] DOLLY

[75] Inventor: George L. Steck, Dayton, Ohio

[73] Assignee: Steck Manufacturing Co., Inc., Dayton, Ohio

[21] Appl. No.: 652,159

[22] Filed: Sep. 18, 1984

Related U.S. Application Data

[63] Continuation of Ser. No. 402,212, Jul. 26, 1982, abandoned.

[51] Int. Cl.[3] ..... B25B 11/00

[52] U.S. Cl. ..... 269/17; 269/274; 269/296

[58] Field of Search ..... 269/17, 296, 274; 254/2 B, 89 R, 89 H; 280/97.12, 97.2; 414/11, 589; 248/188.8, 188.9, 346

[56] References Cited

U.S. PATENT DOCUMENTS

| | | | |
|---|---|---|---|
| 298,257 | 5/1884 | Vail | 248/188.9 |
| 638,997 | 12/1899 | Stock | 248/188.9 |
| 1,081,243 | 12/1913 | Markham . | |
| 1,206,361 | 11/1916 | Parker . | |
| 2,805,839 | 9/1957 | Branick | 254/2 B |
| 3,073,570 | 1/1963 | Harvey | 254/2 B |
| 3,086,664 | 4/1963 | Gribble | 269/17 |
| 3,271,006 | 9/1966 | Brown et al. . | |
| 3,752,463 | 8/1973 | Schilke . | |
| 3,850,409 | 11/1974 | Davis et al. . | |
| 3,858,864 | 1/1975 | Waldow . | |
| 3,881,689 | 5/1975 | Bury et al. . | |
| 3,921,539 | 11/1975 | Berger | 248/188.8 |
| 4,082,250 | 4/1978 | Allmon et al. . | |
| 4,084,792 | 4/1978 | Baron et al. | 254/106 |

*Primary Examiner*—Robert C. Watson

*Attorney, Agent, or Firm*—Dybvig & Dybvig

[57] ABSTRACT

A load supporting dolly is provided with foot portions having underlying and spaced apart rounded heads for engaging and seeking a position of stability on an underlying floor and provided with inclined heel portions supporting rollers to which the weight of said dolly can be transferred by tilting said dolly whereupon the dolly may be rolled by means of the rollers to a different operating station. The dolly includes a rectangular frame having side portions cradling jacking means independently operable alternately to progressively advance the load to a desired position. In one embodiment the dolly is adapted for supporting an automobile door which is to be hinged or unhinged. In another embodiment the dolly is adapted to supporting a bumper which is to be attached or detached from an automobile.

11 Claims, 5 Drawing Figures

DOLLY

This is a continuation of application Ser. No. 402,212, filed July 26, 1982, now abandoned.

SUMMARY

A dolly which is particularly suitable for use in rehinging automobile doors in the course of automobile repair comprises a pair of generally parallel and spaced apart friction jack mechanisms arranged in a rectangular frame which allows a single operator using only one hand to alternately operate the jack mechanisms to incrementally elevate an automobile door to a door hinging position, with the incremental advance of the separate jack mechanisms permitting the door hinges to be adjusted into coaxial alignment with corresponding frame hinges in preparation for the insertion of hinge pins. The dolly includes foot portions, one under each jack mechanism, the foot portions being one piece with the dolly and having rounded head means for applying the weight of the dolly to an underlying floor and, because the head means are rounded, seeking positions of stability on the underlying floor. The foot portions also have slanted heel portions which support rollers to which the weight of the dolly can be transferred by a tilt of the dolly and by means of which the dolly may be conveniently rolled from station to station of a repair shop.

The dolly includes an elastomeric strap for the retention of a door or the like on the dolly and resilient covers which protect the door or the like against abrasion.

In a modification a bumper holder bar is mounted in position to span between opposite sides of the rectangular frame, the holder bar adjustably supporting hook means for holding an automobile bumper in position to be incrementally advanced by the jack mechanisms of the dolly into the appropriate position for attachment to an automobile body.

DETAILED DESCRIPTION

Figure 1:
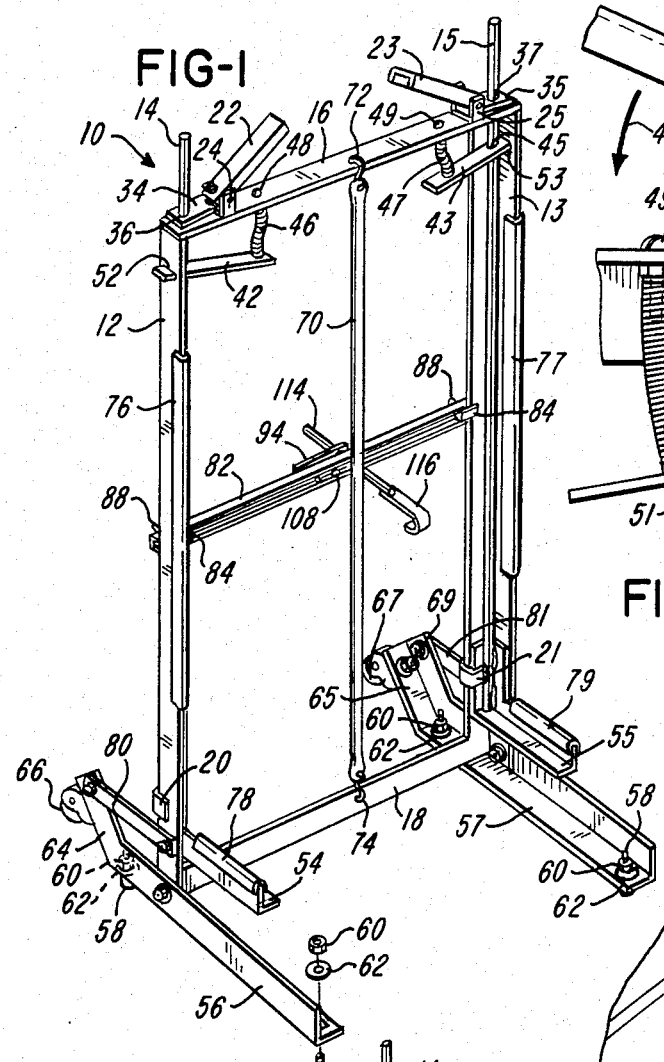
FIG. 1 is a perspective illustration of the dolly showing a bumper holder assembled to the dolly.

Referring to the drawings in detail, the dolly of the present invention is identified generally by the reference number 10 in FIG. 1. Included in the dolly 10 is a rectangular frame comprising upstanding angle bars 12 and 13, the top ends of which are spaced apart by an upper brace 16 and the bottom ends of which are spaced apart by a lower brace 18, the angle bars 12 and 13 and braces 16 and 18 having mitered joints. Cradled for sliding movement in the corner between the adjacent sides of the angle bar 12 as it appears in FIG. 1 is an upstanding jacking rod 14. A similar jacking rod 15 is cradled between the adjacent sides of the angle bar 13 which is depicted to the right in FIG. 1.

Partly girding the upstanding angle bars 12 and 13 are respective guides 20 and 21, the guides 20 and 21 serving as cages to hold the jacking rods 14 and 15 against the inside corners of the angle bars 12 and 13.

Figure 2:
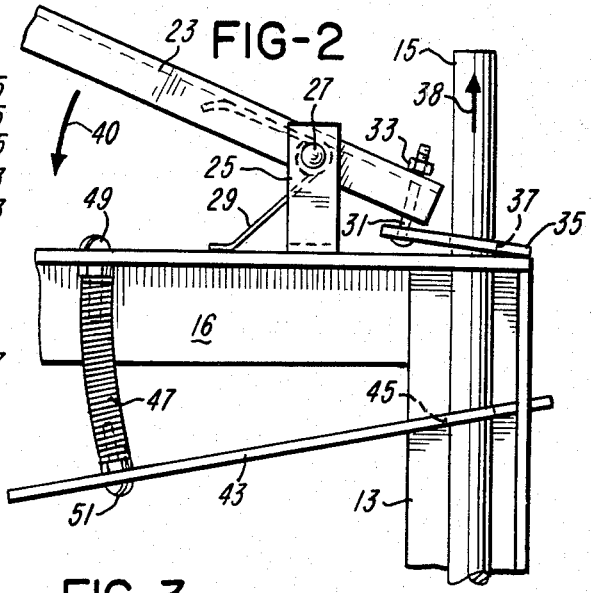
FIG. 2 is an enlarged fragmentary elevation view illustrating the upper right corner of the dolly shown in FIG. 1.

Associated with the jacking rods 14 and 15 are lever arms 22 and 23, the construction of the right side lever arm 23, which is representative of both lever arms, being best illustrated in FIG. 2.

It can be noted that the left and right sides of the dolly are substantial mirror images, one of the other, and in this description, features on the left side of the dolly as shown in FIG. 1, for example, are generally identified by even-numbered characters whereas corresponding features on the right side of the dolly as it appears in FIG. 1 are identified by the next higher and thus odd-numbered characters.

Having particular reference to FIG. 2, there is affixed near the right end of the upper brace 16 a yoke 25 mounting an axle 27 about which the lever arm 23 is permitted to pivot, the lever arm 23 being biased upwardly by a spring 29 having one end pressing upwardly against the lever arm 23 and an opposite end pressing downwardly against the brace 16. As is evident in FIG. 2, the spring 29 takes one loop about the axle 27. The lever arm 23 has a short end projecting towards its associated jacking rod 15 and this short end is secured by bolt 31 and nut 33 to a friction plate 35. The friction plate 35 has a central aperture 37 which is sized to slidably receive the jacking rod 15 passing through such aperture. As well known to those skilled in the art, the friction plate 35, when positioned perpendicular to the axis of the rod 15 permits such rod to slide vertically without appreciable resistance; however, when the friction plate 35 is inclined as it appears in FIG. 2 diametricall opposite of the wall portions defining the aperture 37 seize upon outer surface portions of the jacking rod 15 so that any vertical downward movement of the jacking rod 15 is quickly braked. FIG. 2 thus illustrates the right hand lever arm 23 at a position when the friction plate 35 is seized upon the jacking rod 15 due to initiation of a downward movement of the long end of the lever 23. With continued downward movement of this long end, the jacking rod 15 will be driven upwardly as shown by the arrow 38 appearing in FIG. 2. Due to the mechanical advantage associated with the lever arm 23, it can be appreciated that the incremental travel of the jacking rod 15 will be but a small fraction of the lever arm stroke indicated by the arrow 40 appearing in FIG. 2.

One can assume that the jacking rod 15 appearing in FIG. 2 is biased downwardly by the weight of a load such as an automobile door. Obviously, after the door is lifted incrementally by a downward stroke of the long end of the lever arm 23, the jacking arm 15 will be driven downwardly by the weight of the door as soon as the jacking arm 23 is released. To minimize this type of backslide of the jacking arm 15, a second friction plate 43 is mounted under the brace 16. The friction plate 43 has an aperture 45 through which the jacking rod 15 appearing in FIG. 2 passes. An expansion spring 47 anchored by appropriate fittings 49 and 51 to the brace 16 and to the friction plate 43 biases the free end of the friction plate 43 downwardly as its opposite end is caged in a suitable slot 53 located in one wall of the upstanding right hand angle bar 13. Due to the downward bias delivered by the spring 47, the friction plate 43 is biased to always seize the right hand jacking rod 15 against downward movement while only slightly resisting upward movement of that jacking rod. Of course, after any such upward movement powered by a downward stroke of the lever arm 23, a downward settling of the jacking rod 15 will cause the friction plate 43 to again seize the jacking rod 15. Thus, the total incremental upward movement of the jacking rod 15 resulting from a single stroke of the lever arm 23 is reduced not only by the need to induce seizure by the friction plate 35 but also the need to later induce seizure by the friction plate 43. It can also be noted, of course, that a skilled operator can, by using only partial strokes of the lever arm 23, cause the jacking rod 15 to move upwardly in fractional increments.

The aforegoing remarks have described in detail the operation of the lever arm 23 and associated friction plates 35 and 43 in raising the jacking rod 15. The lever arm 22 is constructed similarly and symmetrically opposite to the lever arm 23 and associated parts. Thus, associated with the lever arm 22 is a yoke 24, a friction plate 34 having an aperture 36 through which passes the jacking rod 14 and a spring 46 secured by fittings such as the fitting 48 and biasing downwardly a friction plate 42 caged in a slot 52 located in one wall of the upstanding angle bar 12, the lever arm 22 being operable to jack upwardly the jacking rod 14 in the same fashion as previously described in reference to the operator of the lever arm 23 to jack upwardly the jacking rod 15.

The lowermost ends of the left and right jacking rods 14 and 15 appearing in FIG. 1 are affixed by welding to horizontally projecting holders 54 and 55. These holders which comprise angle bar members have their upwardly projecting side edges cushioned by elastomeric covers 78 and 79 respectively. The holders 54 and 55 are sized to engage under and support an automobile door as is shown in FIG. 3, where the reference number 120 identifies an automobile door.

The rectangular frame comprising the angle bars 12 and 13 and horizontal braces 16 and 18 is supported normally in an upright position by means of affixed feet 56 and 57 which project forwardly of the angle bars 12 and 13 as the angle bars appear in FIG. 1. The feet 56 and 57 have upwardly inclined heel portions 64 and 65 respectively, to which are mounted rollers 66 and 67 by means of nuts 68 and 69. Spaced along the length of each of the feet 56 and 57 are a pair of carriage bolt means 58 having rounded lower heads, the carriage bolt means being secured by nuts 60 and washers 62 as shown in FIG. 1. With two carriage bolt means 58 for each foot and there being two feet 56 and 57, the dolly 10 is provided with four rounded head portions for engagement with whatever floor underlies the dolly 10. When the dolly is in an upright position substantially as illustrated in FIG. 1, these four rounded heads shift relative to the underlying floor under whatever load is being borne by the dolly to find for themselves a position of stability on the underlying floor. When it is desired to move the dolly 10 from any given point of stability to a different working station, it is necessary only to tilt the dolly 10 rearwardly as it appears in FIG. 1 to transfer the weight of the dolly and any load thereon to the rollers 66 and 67 so that an operator may readily roll the dolly to any new working station. Braces 80 and 81 extending from the heels 64 and 65 to the upstanding angle bars 12 and 13 help to preserve the perpendicularity of the angle bars 12 and 13 relative to the feet 56 and 57. Also to minimize abrasion to any loads such as an automobile door, elastomeric covers 76 and 77 are secured to the exposed upper surfaces of the angle bars 12 and 13. Further to retain the automobile door or any other load on the dolly an elastic strap 70 is attached by a hook 72 to any suitably located aperture in the brace 16 and by another hook 74 to any suitably located aperture in the brace 18.

Figure 3:
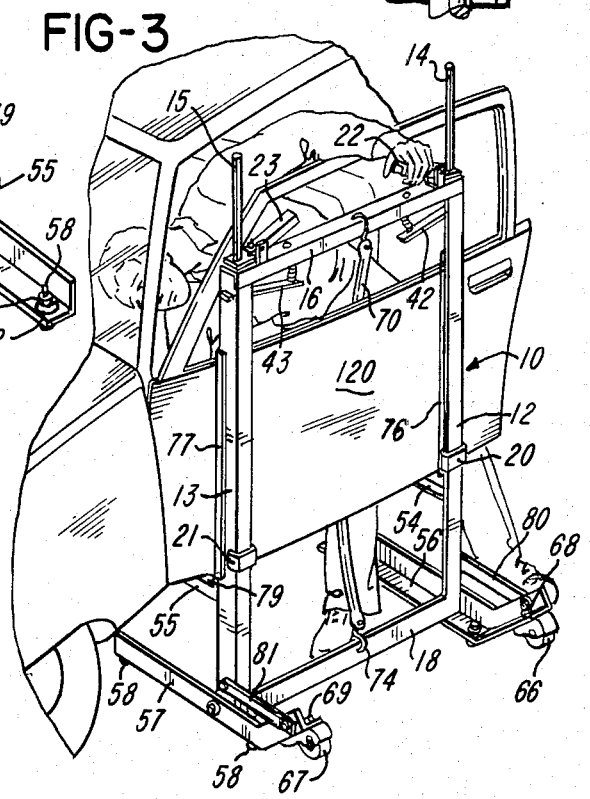
FIG. 3 is a perspective illustration of the dolly supporting an automobile door adjacent an automobile frame shown in fragmentary detail, FIG. 3 also illustrating a repair man in position to incrementally adjust the position of the automobile door being supported by the dolly.

FIG. 3 shows the dolly 10 with the bumper holder bar 82 appearing in FIG. 1 having been removed to allow performance of an automobile door holding function. The door 120 appearing in FIG. 3 is supported primarily by the holders 54 and 55. A mechanic appearing in FIG. 3 has placed himself in position to visually observe the alignment between door hinges and frame hinges. After having manipulated the left hand and right hand levers 22 and 23 to jack the door upwardly to the proper elevation and having manually slided the door on the holders 54 and 55 so that the door hinge parts at least partially interfit the frame hinge parts, the mechanic then needs to inspect the partially assembled hinges to determine to what extent and in what direction the inclination to the horizontal of the door might have to be adjusted to completely interfit the hinge parts. At this point it is to be understood that a door, such as illustrated in FIG. 3, is mounted by two hinges, namely, an upper hinge, not shown, and a lower hinge, not shown, and the mounting of the door to the automobile frame will require the insertion of two hinge pins. After inspecting the alignment of the parts comprising these upper and lower hinges, the mechanic can then manually adjust the left hand and right hand levers to change the horizontal inclination of the door as needed to align the hinge parts so that they are axially parallel and then, with a manual pressure, slide the door laterally on the holders 54 and 55 to achieve coaxial alignment of the hinge parts, whereupon the hinge pins are readily inserted.

Figure 4:
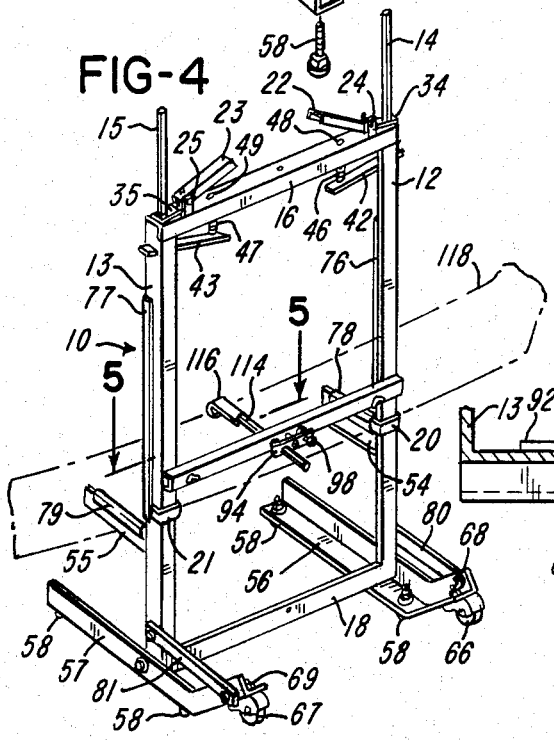
FIG. 4 is a perspective illustration of the dolly when adapted for use as a bumper holder, an automobile bumper being fragmentarily illustrated in phantom detail.
Figure 5:
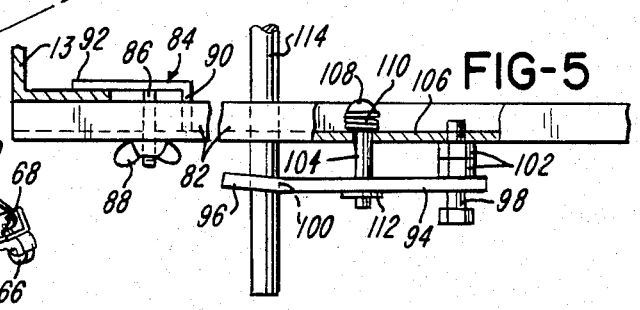
FIG. 5 is a fragmentary section illustration with a portion broken away taken substantially along the line 5—5 of FIG. 4.

FIGS. 4 and 5 illustrate a modification wherein the dolly 10 has been adapted for use as an automobile bumper holder. To this end the bumper holder 82 which appears in FIG. 1 and which was removed for purposes of door holding as illustrated in FIG. 3, has been returned to the dolly as it is shown in FIGS. 4 and 5.

The bumper holder 82 is in the form of a horizontally disposed channel which, as shown in FIG. 5, is clamped to one side of the angle bar 12 by means of an L-shaped clamp 84 retained to the holder 82 by means of a threaded bolt 86 which is threadedly engaged by a wing nut 88. For accomplishment of this assembly, the bolt 86 is passed through a suitably located aperture located in the center web of the channel bar which comprises the holder 82. Upon tightening of the wing nut 88, the clamp 84 is drawn toward the holder 82 so that its leg 90 presses against the web of the channel bar while its wall 92 pinches one side of the angle bar 12, thus to clamp the holder 82 to the angle bar 12. A similar clamp not detailed in the drawings clamps the opposite end of the holder 82 to the angle bar 13. The torque applied to the wing nuts which effect clamping is deliberately small or light so that the bumper holder bar 82 is not permitted to resist jacking of a bumper supported by the holder bar as will be described.

For attachment of a bumper to the holder bar, the web 106 of the holder bar 82 is apertured to receive a bolt 104 having an enlarged head 108 confining a compression spring 110 against the web 106. The bolt 104 is provided with an annular groove, not illustrated, which allows the bolt 104 to be seized by a "C" clip 112 which confines on the bolt 104 a friction plate 94 having a sloped end 96 through which passes an aperture 100 for receiving a rod 114. Due to the slope in the end 96, wall portions of the aperture 100 seize upon the outer wall of the rod 114 even at times when the plate 94 is parallel to the web 106. Thus, the rod 114 can slide freely in the aperture 100 away from the web 106 against the tension of the spring 110.

To allow this lifting action to occur, the end of the friction plate 94 which is opposite the sloped end 96 is apertured to receive a bolt 98 threadedly engaged in a suitably threaded aperture in the web 106 and locked in position with respect of the web 106 by means of countertorqued, internally-threaded, hex nuts 102. The hex nuts 102 provide a fulcrum which, in response to the tension of the spring 110, causes the sloped end of the friction plate 94 to tilt toward the web 106.

As appears in FIG. 4, the rod 114 is integrally affixed to a bumper holding hook 116. To mount the holding hook 116 in position, the rod 114 is forced through the apertured web 106 with a force sufficient to overpower the spring 110 and thereby push the friction plate 94 downwardly from the web 106 as it appears in FIG. 5 to align the aperture 100 with the axis of the rod 114 which can then pass freely through the aperture 100. By reason of this construction, the rod 114 can be manually advanced downwardly as it appears in FIG. 5 but is immediately braked against any upward or reverse movement by the action of the spring 110 acting in conjunction with the slope in the sloped end 96 of the friction plate 94. It should be noted, of course, that by manually overpowering the spring 110, the position of the rod 114 can be adjusted as desired.

In a typical bumper removal operation, the dolly 10 is adjusted on the floor or pavement underlying the bumper to be removed so that its feet 56 and 57 project under the bumper 118. The wing nuts 88 are loosened as desired to allow adjustment of the holder bar 82 so that the hook 116 can be initially well above the bumper 118. The levers 22 and 23 are then manipulated, as needed, to lift the holders 54 and 55 so that they lightly engage the bottom of the bumper 118. Then the bumper holder bar 82 is brought downwardly and the rod 114 moved inwardly or outwardly as required to cause the hook 116 to engage an upper edge of the bumper 118. The bumper 118 being now securely attached to the dolly 10 can next be detached from the vehicle frame in the usual fashion as by bolt removal or the like and removed from the vehicle for repair and/or replacement.

At such time as the bumper 118 or a replacement therefore is to be reattached to the vehicle chassis, it may be necessary to readjust one or both of the levers 22 and 23 because the initial bumper removal may have caused the chassis to rise slightly. With appropriate manipulation of the levers 22 and 23, the elevation of the bumper then supported on the dolly is adjusted for the alignment of securing bolts and the like. Upon affixation of the bumper to the vehicle chassis, the hook 116 is released by an appropriate manipulation of the friction plate 94. Then the jacking rods 14 and 15 are lowered as may be necessary by manipulation of the friction plates 42 and 43, thus to free the dolly 10 for easy removal from the vicinity of the repaired automobile.

While the present invention has been described in reference to the repair of automobile doors and automobile bumpers, it will occur to those skilled in the art that the dolly 10 is suitable for numerous operations not necessarily limited to automobile repairs.

Although the preferred embodiment of this invention has been described, it will be understood that various changes may be made within the scope of the appended claims.

Having thus described my invention I claim:

1. A dolly for transporting and positioning a load comprising a rectangular frame member having side portions and having brace portions fixed to said side portions and holding said side portions in spaced apart relation, said side portions comprising angle bars each having a closed corner and including friction jack means disposed in said closed corners, each jack means having a jacking rod cradled in its closed corner, foot portions affixed to said frame member and underlying said spaced apart side portions, said foot portions having rounded head portions at the underside thereof for engaging and seeking positions of stability upon an underlying floor to which said head portions transfer the weight of said dolly and any load supported thereby, said foot portions projecting forwardly of said frame and having heel portions projecting rearwardly of said frame and inclined upwardly from said foot portions, and including a roller for each of said heel portions and means mounting said rollers to said portions for rolling movement of said rollers after tilting said frame to transfer the weight of said frame and any load supported thereby to said rollers.

2. The dolly of claim 1 including guide means girding each of said angle bars for retention of said jacking rods adjacent said closed corners.

3. The dolly of claim 1 wherein each of said jack means comprises a first friction plate having an aperture through which a jacking rod passes and having the margins defining said aperture seizingly engagable with said jacking rod when said friction plate is disposed oblique to the axis of said jacking rod and including lever means mounted on one of said brace portions for driving said friction plate to an oblique position.

4. The dolly of claim 3 wherein each of said jack means further includes a second friction plate having an aperture through which its jacking rod passes and bias means biasing said second friction plate obliquely of the axis of said jacking rod.

5. The dolly of claim 1 including holding means affixed to and projecting outwardly from said jacking rods and forwardly of said rectangular frame.

6. The dolly of claim 5 including resilient cover means lying over said holding means.

7. The dolly of claim 5 further including elastomeric strap means having end hooks engaged to opposite ones of said brace portions for retaining a load resting on said holders.

8. The dolly of claim 7 further including elastomeric cover means extending along edges of said side portions for protecting against abrasion a load retained by said strap means.

9. The dolly of claim 1 including a holding bar spanning the space between said side portions, a third friction plate, fulcrum means mounting one end of said third friction plate to said holding bar, said friction plate having an opposite end sloped toward said bar and an aperture through said opposite end, and yieldable means biasing said sloped end toward said holding bar.

10. The dolly of claim 9 including clamp means for clamping said holding bar to said angle bars, said clamp means adjustable to allow movement of said holding bar along said side portions.

11. Means for positioning a load comprising a rectangular frame member having side portions and having brace portions fixed to said side portions and holding said side portions in spaced apart relation, said side portions comprising angular bars each having a closed corner, friction jack means disposed in each of said closed corners, each jack means having a jacking rod cradled in its closed corner, each jack means further comprising a first friction plate having an aperture through which a jacking rod passes and having the margins defining said aperture seizingly engagable with said jacking rod when said friction plate is disposed oblique to the axis of said jacking rod, each jack means further including lever means mounted on one of said brace portions for driving said friction plate to an oblique position to lift the jacking rod seized in its aperture, each jack means further including a second friction plate having an aperture through which its jacking rod passes and bias means biasing said second friction plate obliquely of the axis of said jacking rod, holding means affixed to and projecting outwardly from said jacking rods and forwardly of said rectangular frame for holding a load, said load positioning means so constructed and arranged that said load may be positioned by alternate operations of said lever means to raise and horizontally adjust said load.

* * * * *

UNITED STATES PATENT AND TRADEMARK OFFICE

CERTIFICATE OF CORRECTION

PATENT NO. : 4,538,796

DATED : Sep. 3, 1985

INVENTOR(S) : George L. Steck

It is certified that error appears in the above-identified patent and that said Letters Patent are hereby corrected as shown below:

Column 2, lines 40-41, "diametricall" should be ---diametrically ---.

Column 6, line 29, after "said" should appear ---heel---.

Signed and Sealed this

*Thirty-first* Day of *December 1985*

[SEAL]

*Attest:*

DONALD J. QUIGG

*Attesting Officer*

*Commissioner of Patents and Trademarks*